US006457666B1

(12) United States Patent
Niederer

(10) Patent No.: US 6,457,666 B1
(45) Date of Patent: Oct. 1, 2002

(54) FULL-COMPENSATING TENSION CONTROLLER

(75) Inventor: Kurt W. Niederer, Charlotte, NC (US)

(73) Assignee: Texkimp Limited, Northwich (GB)

( * ) Notice: Subject to any disclaimer, the term of this patent is extended or adjusted under 35 U.S.C. 154(b) by 0 days.

(21) Appl. No.: 09/673,682

(22) PCT Filed: May 18, 1999

(86) PCT No.: PCT/US99/10936

§ 371 (c)(1),
(2), (4) Date: Oct. 19, 2000

(87) PCT Pub. No.: WO99/59908

PCT Pub. Date: Nov. 25, 1999

(51) Int. Cl.[7] ..... B65H 59/18

(52) U.S. Cl. ..... 242/419.9; 242/421.7; 242/421.8; 242/147 M-155 M

(58) Field of Search ..... 242/365.7, 419.8, 242/419.9, 421.7, 421.8, 421.9, 147 M, 155 R, 155 M, 155 BM; 226/195

(56) References Cited

U.S. PATENT DOCUMENTS 2,034,267 A 3/1936 Nydegger
3,034,744 A 5/1962 Bancroft
5,324,909 A 6/1994 Derighetti
5,454,151 A 10/1995 Bogucki-Land et al.

*Primary Examiner*—Michael R. Mansen
(74) *Attorney, Agent, or Firm*—Adams Schwartz & Evans

(57) ABSTRACT

A strand tension apparatus, including a strand delivery mechanism for controllably delivering a moving strand under tension downstream from a strand supply, a strand take-up mechanism positioned downstream from the strand delivery mechanism for pulling the strand from the strand supply, and a tension controller positioned between the strand delivery mechanism and the strand take-up mechanism for adding tension to the moving strand as it moves downstream from the strand delivery mechanism to the strand take-up mechanism. The tension controller includes a rotating strand feeding device frictionally-engaging the strand and a variable drag force-applying device cooperating with the rotating strand feeding device for adding a predetermined tension to the strand as the strand is delivered downstream from the strand delivery mechanism. A tension responsive drag-force varying device cooperates with the drag-force applying device and is responsive to the tension on the strand being delivered from the strand delivery mechanism for reducing the amount of drag added to the strand by the drag-force applying device by a value resulting in delivery of a strand under uniform tension downstream from the tension controller to the take-up mechanism.

23 Claims, 22 Drawing Sheets

FULL-COMPENSATING TENSION CONTROLLER

This application is a national stage application, according to Chapter II of the Patent Cooperation Treaty. This application claims the priority date of May 20, 1998 for United States Provisional Patent Application No. 60/086,105.

TECHNICAL FIELD AND BACKGROUND OF THE INVENTION

This invention relates to an apparatus and method for controlling the tension in moving yarns. More specifically, it compensates for varying tension over the time of a process and results in consistent yarn tension, which is often desirable for the next downstream process. As a further refinement on the principle of outputting a uniformly tensioned yarn at a single station is a method and apparatus for, remotely adjusting the tension of a group of tension devices simultaneously at any time during the process as well as an individual fine-tuning of the tension for each individual yarn is disclosed.

Numerous types of tension devices are known for controlling yarn tension. These include mostly devices which add constant tension to the traveling yarn and through this method reduce the percentage of the fluctuating tension. Most of those apply pressure directly to the traveling yarn, which in turn adds tension, based on the product of applied force times the friction coefficient. However, frictional forces directly applied to the yarn can damage the yarn itself Another problem with this kind of tension device is that the yarn, which is pinched between two stationary members, can cause additional irregular tension, this is especially the case if the yarn is of uneven thickness. If for example a thick place in the traveling yarn passes this pinching place, the members are forced apart, causing a tension peak due to the mass of the stationary members, resisting the opening motion of the thick place in the yarn. Another problem with a frictional tension device is the variation of the friction coefficient of the yarn. This is especially true for unevenly waxed or oiled yarns.

More sophisticated yarn tensioning systems use complex and expensive electronic means to measure the yarn tension and electronically vary the applied tension with a close-loop feedback to achieve constant output tension.

The invention disclosed in this application employs a rotating yarn whorl around which the yarn is wrapped with sufficient wrapping angle to prevent slippage between the yarn and the yarn whorl during normal operation. Tension is applied to the yarn by braking the yarn whorl through means of mechanical frictional force, electrical eddy-current and others. The disclosed invention achieves constant output tension by reducing the applied tension by the same value as the amount of upstream tension of the yarn. Since the total downstream tension is the sum of the tension upstream of the tension device and the tension added by the tension device, the downstream tension in the disclosed invention is constant.

The invention works with the principle that the tension of the upstream is used as the means to change the applied tension of the tension controller. In a preferred method the tension of the upstream yarn strand is pulling the yarn whorl partially away from a tension generating brake and through this means reduces the added tension. The geometry of the braking force is chosen in such a manner as to reduce the set tension by exactly the same amount as the tension residing in the upstream yarn strand, hence achieving constant tension in the downstream yarn strand. It is naturally understood that if the incoming yarn tension exceeds the preset tension of the tensioning system, the yarn whorl is lifted completely from the brake shoe and the full upstream tension is transmitted downstream.

OBJECT AND SUMMARY OF THE INVENTION

Accordingly it is an object of the present invention to provide a yarn tension controller for maintaining uniform yarn tension for delivery to a downstream yarn processing station.

It is another object of the invention to provide a yarn tension controller which allows to set a desired tension level and tension uniformity downstream from the yarn tension controller.

It is another object of the invention to provide a yarn tension controller which includes means for uniformly and simultaneously setting the yarn tension on a plurality of yarns being processed.

It is another object of the invention to provide a yarn tension controller where each unit can be individually trimmed to fine-adjusted it to suit specific needs in a downstream yarn processing station.

It is another object of the invention to provide a multiple set of yarn tension controllers for which the desired tension level in all yarns can be changed simultaneously to fit a specific need in a downstream yarn processing station.

These and other objects of the present invention are achieved by providing a yarn tension controller by applying a drag force to a whorl around which the yarn is wrapped to achieve a desired tension. If the incoming strand has no tension, the full drag force is applied to the whorl. If the incoming strand has tension, the drag force is proportionally reduced.

It is an object of the invention to achieve the drag force to the whorl by mechanical means.

It is another object of the invention to achieve the drag force to the whorl by electrical means.

It is an object in the preferred embodiments disclosed below to provide a mechanical yarn tension controller, comprising a yarn guiding entrance, a pivoted yarn whorl assembly, a stationary braking means for the whorl, a tensioning pin as a force applying means and a yarn exiting guide. The yarn whorl is by itself freewheeling and the yarn whorl assembly is pivoted at it's bearing extension. This allows the yarn whorl assembly to pivot in plane defined by the direction of the entering yarn and the rotational axis of the yarn whorl. The yarn whorl assembly is pushed away from the entering yarn by a tension pin, which presses the yarn whorl against a stationary brake shoe.

It is another object of the invention to apply a brake to a freely rotating whorl by exerting a force to a brake shoe and then reducing this force through the tension of the incoming yarn strand to achieve a constant out-put tension downstream strand.

It is another object of the invention to achieve a constant out-put tension in the yarn by a yarn tension controller, comprising a yarn guiding entrance, a yarn whorl assembly, an electromagnet which is applying a drag force to the whorl through its eddy-current, a redirection of the incoming up-stream yarn strand and a tension sensing transducer at the point of redirection of the incoming up-stream yarn strand which generates a voltage change at the electromagnet which reduces the magnetic braking force of the whorl correspondingly.

It is another object of the invention to achieve a constant out-put tension in the yarn by a yarn tension controller, comprising a yarn guiding entrance and a yarn whorl assembly and an electromagnetic braking means for the whorl. The yarn whorl is by itself freewheeling and the yarn whorl assembly is pivoted at it's stationary bearing extension. This allows the yarn whorl assembly to pivot in the plane of the entering yarn and the yarn whorl axis. An electric transducer between the pivotal whorl assembly and the fixed body of the tension controller measures the tension in the incoming yarn strand and reduces the applied tension by the same amount.

It is another object of the invention to achieve a constant out-put tension in the yarn by a yarn tension controller, comprising a yarn guiding entrance and a yarn whorl assembly and an electromagnetic braking means for the whorl. The yarn whorl is by itself freewheeling and the yarn whorl assembly is mounted onto a flexible support strip which is deflected by the tension in the incoming yarn towards this incoming yarn strand. This flexible support strip is equipped with an electric transducer measuring its deformation and reduces the applied tension by the same amount.

It is an object of the invention to have a mechanical tension controller, where the tension force of the exiting yarn strand is perpendicular to the swinging motion of the whorl assembly so as not to influence the brake.

It is an object of the invention to have an electrical tension controller where the tension force of the exiting yarn strand is perpendicular to the measuring direction of the transducer so as not to influence the measurement of the transducer.

It is an object of the invention to have the tension force of the entering upstream portion of the yarn in opposition direction to the applied braking force of the mechanical yarn tension controller and through this method reducing the preset controller tension, resulting in a constant output tension regardless of tension fluctuations in the upstream yarn strand.

It is another object of this invention to use different geometrical force multipliers to compensate for different coefficient of friction between the brake shoe and the yarn whorl. This geometrical force multiplier can be of various designs as for example the usage of a larger whorl diameter for the brake shoe, then for the yarn, if the coefficient of friction is smaller than one. Other methods of force multiplication can be used to compensate for different friction coefficients as are well known in physics such as the application of a leverage system or applying the force in wedge form.

According to one preferred embodiment of the invention, the friction means comprises a stationary brake shoe inside of the rotating yarn whorl, a pivotal yarn whorl assembly and a force means to engage the brake shoe and the yarn whorl.

According to a preferred embodiment of the invention, the position of the brake shoe can be individually changed to alter the geometrical multiplication factor which compensates for different friction coefficient.

According to another preferred embodiment of the invention, the force means comprises a pressure responsive expandable fluid reservoir.

According to yet another preferred embodiment of the invention, the fluid reservoir comprises a tube and includes pressure adjusting means for adjusting the pressure within the reservoir. Preferably, the fluid comprises air.

According to another preferred embodiment of the invention, tension range adjustment means are provided for adjusting the range of tension applied by the friction means.

According to another preferred embodiment of the invention, an individual fine-tuning of each yarn tension controller is provided to decrease or increase the set tension applied to the individual yarn of a selected tension controller.

According to one preferred embodiment of the invention, the air tube extends to the plurality of yarn tension controllers for simultaneously and uniformly control of the force applied to the yarn at each of the plurality of yarn tension controllers by the tension shoes.

According to one preferred embodiment of the invention, the fluid pressure of all air tubes in a processing system can be automatically raised or lowered, as for example during a speed change of the process.

According to yet another preferred embodiment of the invention, the step of applying a maximum desired pre-set tension to the yarn between the yarn supply station and the yarn processing station comprises applying the tension from a single fluid filled pressure reservoir to each of the yarn tension controllers uniformly and simultaneously.

According to yet another preferred embodiment of the invention the force means to apply pressure to the brake is a spring.

According to yet another preferred embodiment of the invention the force means to apply pressure to the brake is a magnet.

According to yet another preferred embodiment of the invention the force means to apply pressure to the brake is a weight.

According to yet another preferred embodiment of the invention the force means to apply pressure to the brake is fluid pressure.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
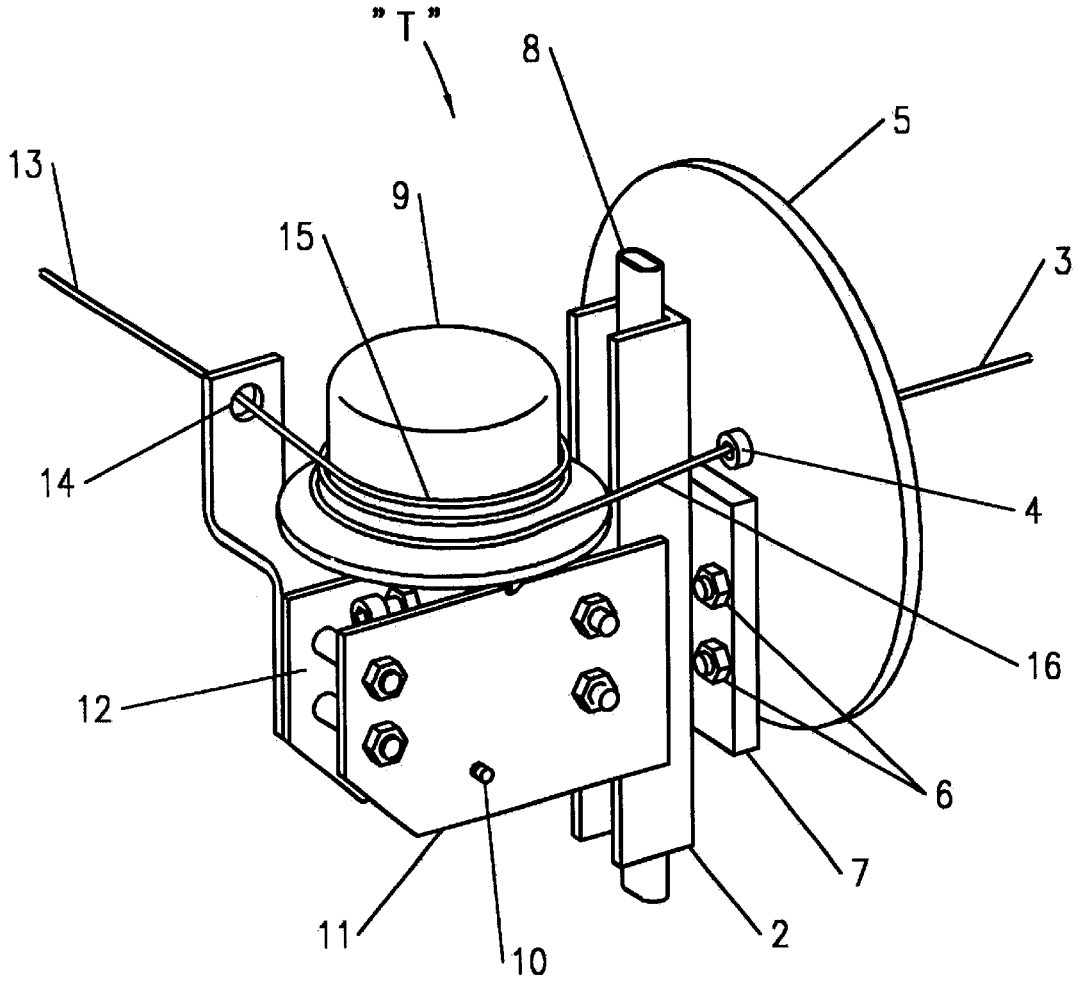
FIG. 1 is a perspective view of the tension controller according to one embodiment of the invention.
Figure 1A:
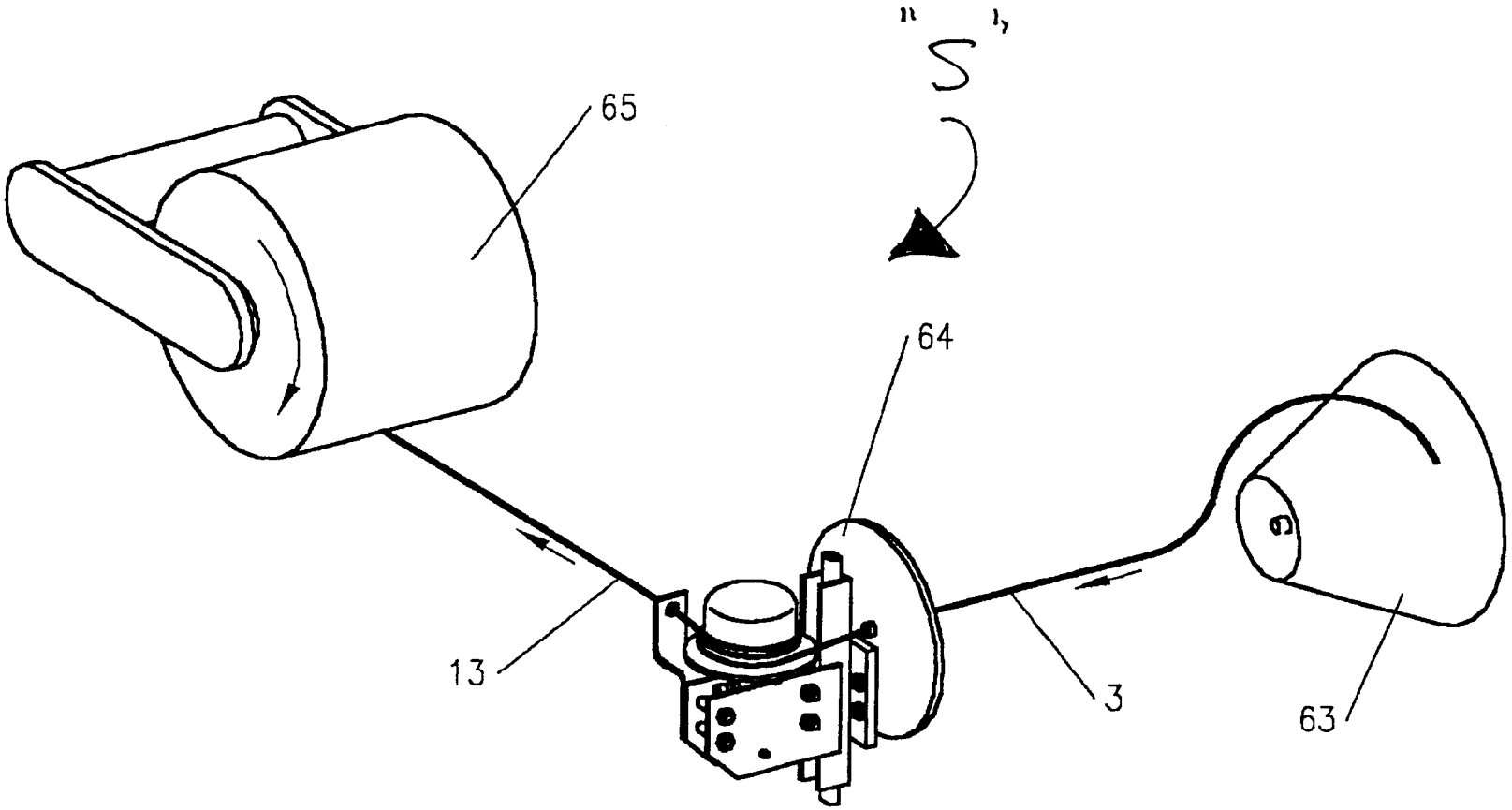
FIG. 1A is a simplified schematic perspective view of the path of the strand from the supply to the take-up according to an embodiment of the invention.

Referring now specifically to the drawings, a tension controller is illustrated in FIG. 1 and broadly illustrated at "T." The tension controller "T" is shown in its environment as a part of a strand tension apparatus, including a strand supply and take-up mechanism in FIG. 1A at "S."

All of the components of the tension controller "T" are mounted on a vertical u-channel 2. An incoming yarn strand 3 is guided through a guide 4 mounted in a shield disk 5 which in turn is fastened by two screw assemblies 6 onto a mounting angle 7. The u-channel 2 may be of any desired length and is fastened to a machine frame, creel etc. (not shown). An air tube 8 containing compressed air is located inside the u-channel 2. A yarn whorl 9 is pivotally mounted through an axle 10 in the axle 10 and front plate 11. The exiting yarn strand 13 leaves the tension controller "T" through the exit guide 14. Sufficient yarn wraps 15 are laid around the yarn whorl 9 to assure a slip free contact of the yarn wraps 15 with the yarn whorl 9.

Figure 2:
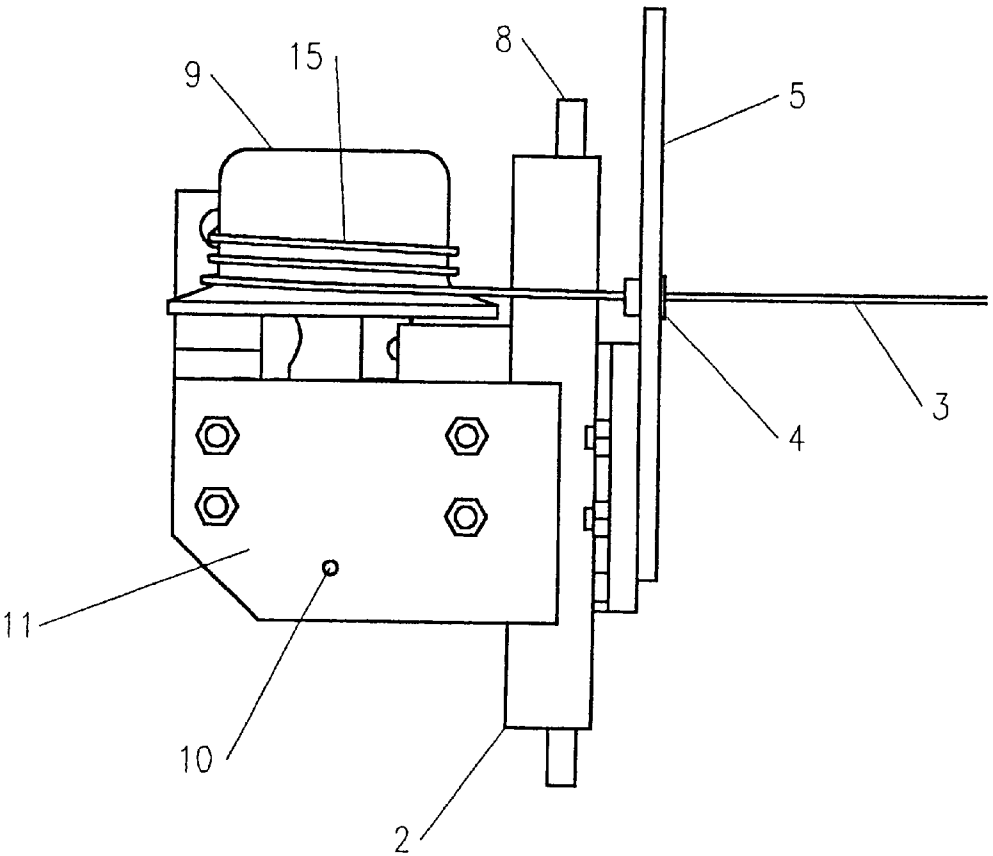
FIG. 2 is a front view of the tension controller viewing it in the direction of the exiting yarn strand.

Referring now to FIG. 2, the same parts are shown in front view.

Figure 3:
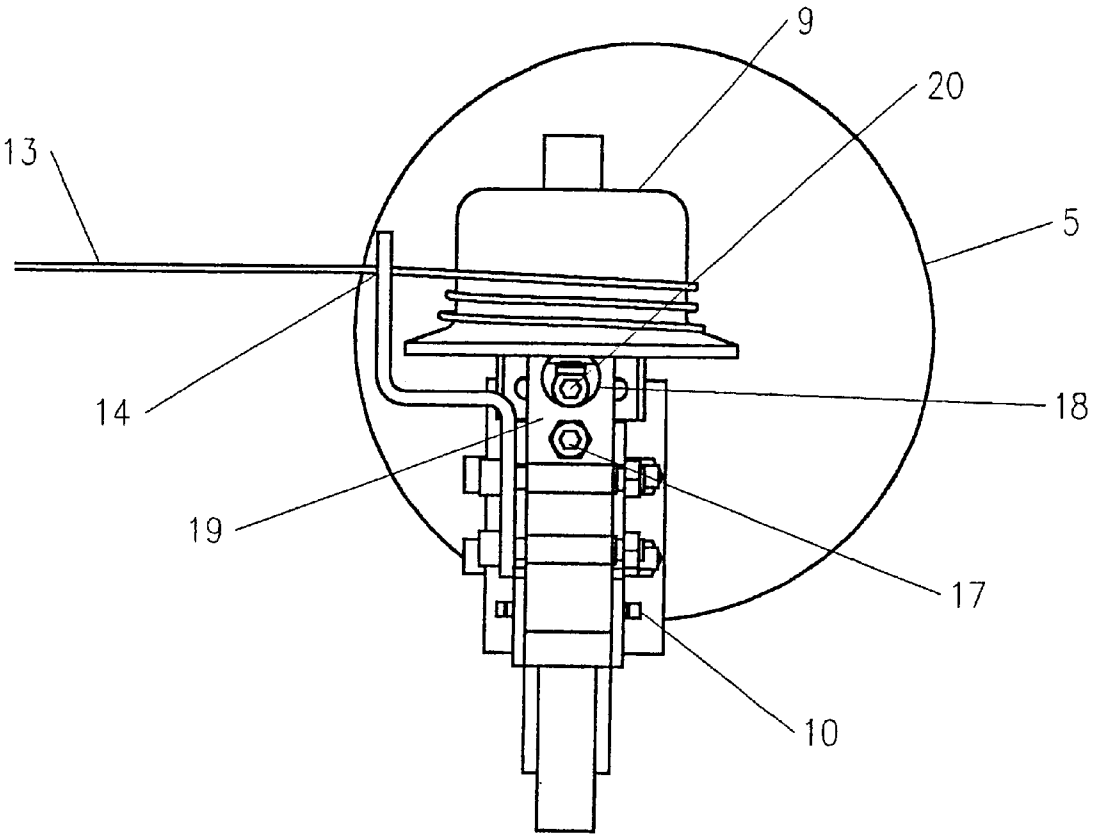
FIG. 3 is a left side view of the tension controller with the exiting yarn strand leaving to the left.

Referring now to FIG. 3, the left view shows the adjustment screw 17 for the individual tension adjustment. Through the access hole 18 of the stem 19 the brake setting screw 20 can be seen.

Figure 4:
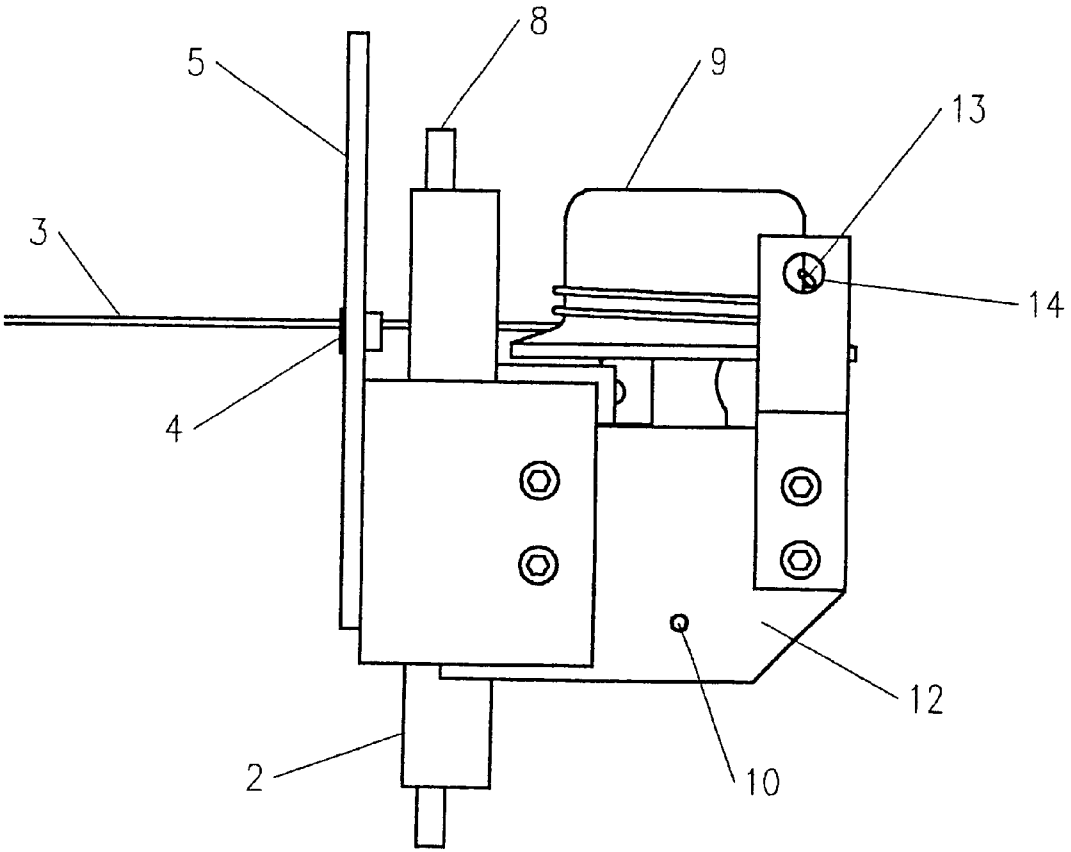
FIG. 4 is a back view of the tension controller with the yarn strand entering the tension controller from the left.

Referring now to FIG. 4, the tension controller "T" is shown in the back view with the exiting yarn strand 13 guided by the exit guide 14.

Figure 5:
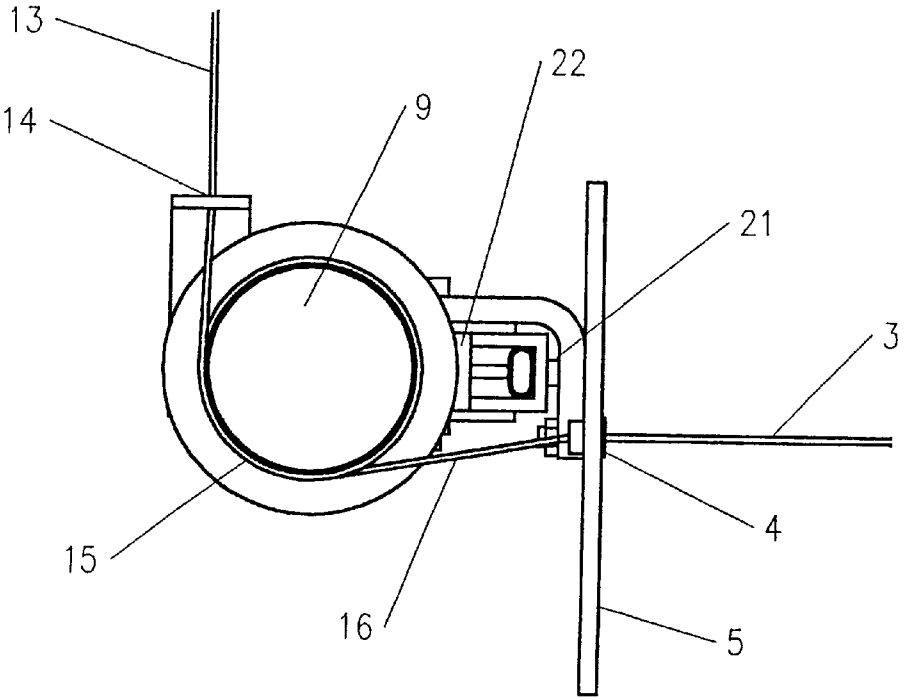
FIG. 5 is a top view of the tension controller viewing with the yarn strand entering the tension controller from the right and exiting to the top.

Referring now to FIG. 5, the incoming yarn strand 3, yarn strand 16, yarn wraps 15 and exiting yarn strand 13 are shown from the top. A set screw 21, threaded into the mounting angle 7 pushes against the u-channel 2 which is held on the opposite side against the brake block 22.

Figure 6:
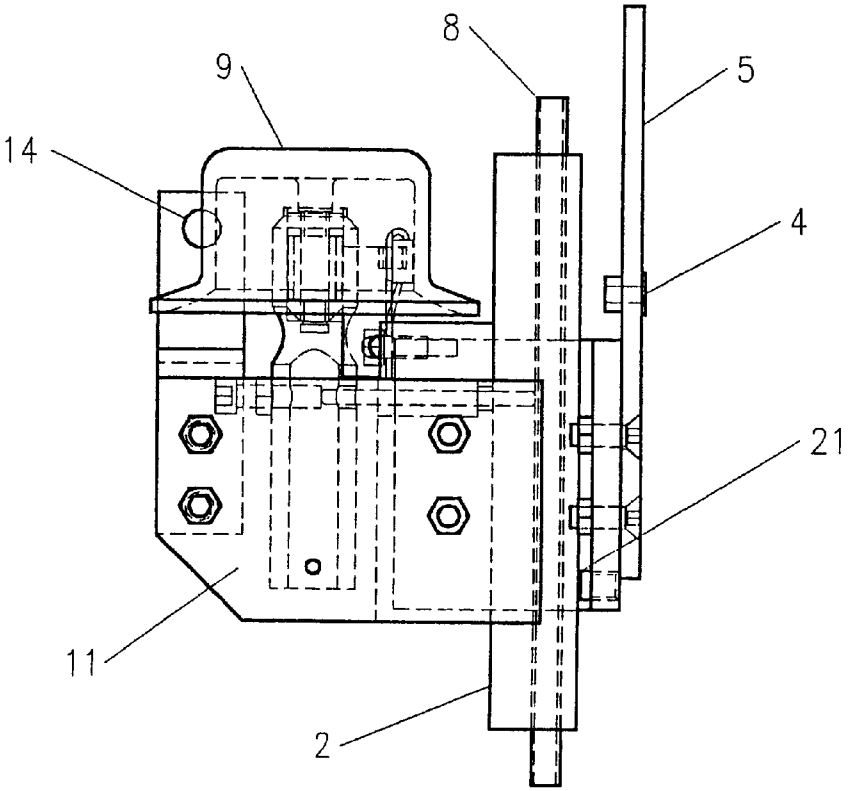
FIG. 6 is a front view of the tension controller viewing it in the direction of the exiting yarn with showing the hidden parts in dashed lines.

Referring now to FIG. 6, all hidden parts are shown from the front view.

Figure 7:
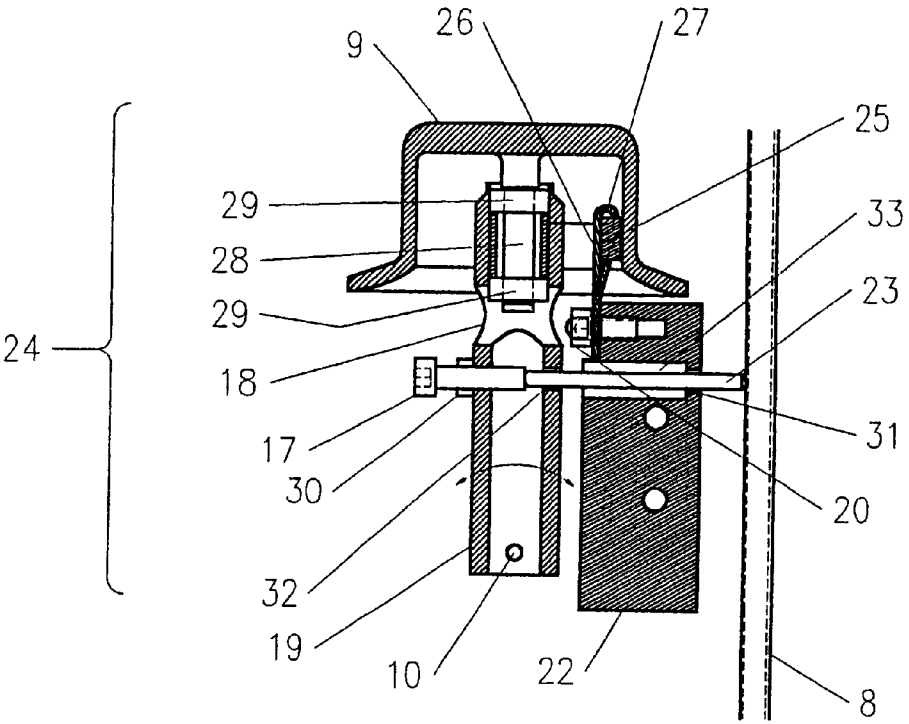
FIG. 7 is a sectioned front view of the tension controller viewing it in the direction of the exiting yarn.

FIG. 7 shows the tension inducing mechanism in a sectional front view. The pressurized air tube 8 pushes the connecting pin 23 toward the left against the adjustment screw 17. Since the adjustment screw 17 is screwed into the stem 19 this force tries to rotate the whorl assembly 24 counter clockwise around it's axle 10. A locking nut 30 assures that the setting of the adjustment screw 17 does not change. The whorl assembly 24 is prevented from rotating counter clockwise by the brake shoe 25. The brake shoe 25 is mounted onto the brake bracket 26 by bracket tabs 27. The yarn whorl 9 is mounted in the stem 19 by it's whorl axle 28 through two ball bearings 29 and can freely rotate around it's whorl axle 28. The brake bracket 26 is fastened unto the brake block 22 by a brake setting screw 20. The connecting pin 23 is loosely held by the block hole 31 in the brake block 22 and on the left in the pin hole 32 of the stem 19. A relieve hole 33 in the brake block 22 assures that the connecting pin 23 can transmit the tension force unhindered from the air tube 8 to the whorl assembly 24. The whorl assembly 24 consists of yarn whorl 9, ball bearing 29, whorl axle 28, adjustment screw 17, stem 19 with the axle 10.

Figure 8:
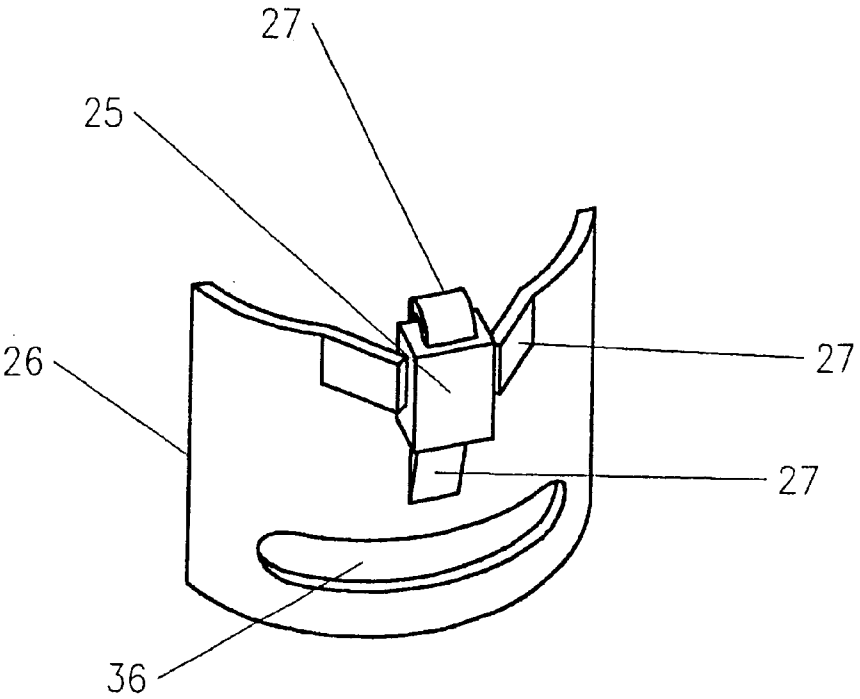
FIG. 8 shows how the brake shoe is mounted in the brake bracket.

FIG. 8 shows the detail of the brake shoe 25 held through bracket tabs 27 in the brake bracket 26.

Figure 9:
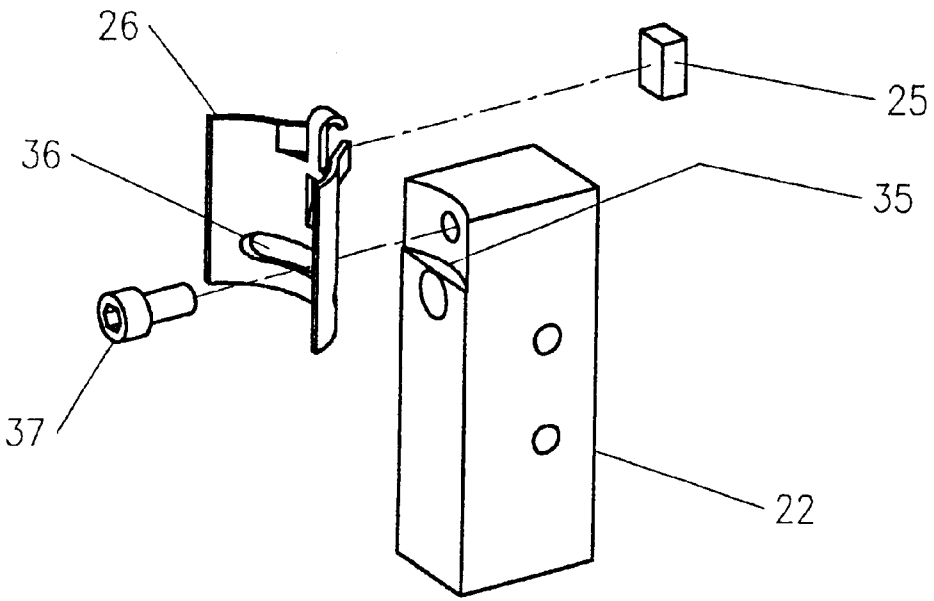
FIG. 9 shows in detail how the brake with its brake bracket and can be rotated around the axis of the arc of the brake block for adjustment of the friction multiplier.

Referring now to FIG. 9, the mounting of the brake bracket 26 to the brake block 22 is shown in more detail. The brake block 22 is provided with an arc shaped cut-out 35 which has it's center in line with the center of the whorl assembly 24. The brake bracket 26 is attached to the brake block 22 by a bracket screw 37 through the adjustment slot 36 which allows the brake bracket 26 to be rotated in relation to the brake block 22 for proper adjustment.

Figure 10:
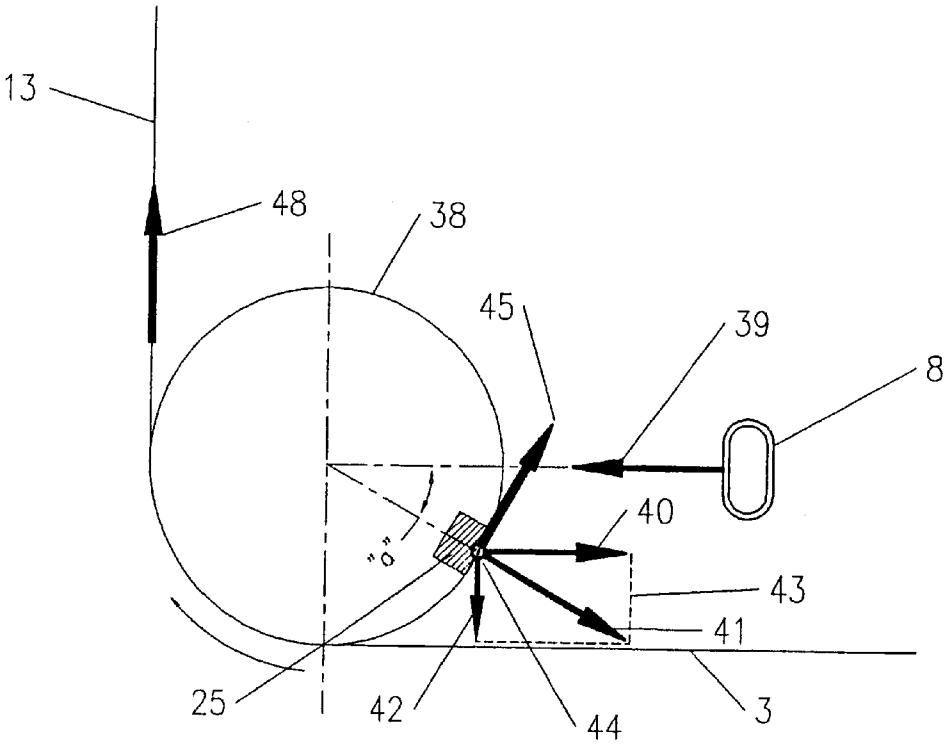
FIG. 10 is a force diagram and demonstrates how the braking force can be adjusted for a different coefficient of friction between the brake shoe and the inside of the yarn whorl.

FIG. 10 is a force diagram. The air tube 8 pushes the whorl assembly 24 by it's air pressure in the direction of 9:00 o'clock. The inside surface 38 of the yarn whorl 9 pushes against the fixed brake shoe 25 and through its friction generates the applied tension force for the exiting yarn strand 13. The forces involved are shown through force vectors. The generating loading force 39 creates at the brake shoe 25 a reaction force 40. The force parallelogram 43 demonstrates the force multiplication in this system as follows: Since the reaction force 40 is not perpendicular to the brake shoe 25 at contact point 44 the reaction force 40 is broken up into a normal force 41 and a side thrust 42. The side thrust 42 is counteracted in the axle 10 of the whorl assembly 24 and does not play any function in the tension generation of the tension controller "T". Since it is counteracted in the axle 10 of the whorl assembly 24. The product of the normal force 41 and the friction coefficient of the brake shoe 25 and the inside surface 38 generates a drag force 45 which is tangential to the inside surface 38 at the contact point 44 of the brake shoe 25. This drag force 45 is generating the desired yarn tension 48 in the exiting yarn strand 13. It should be noted that the cosine function of the angle "a" is equal to the friction coefficient between the brake shoe 25 and the inside surface 38.

Figure 11:
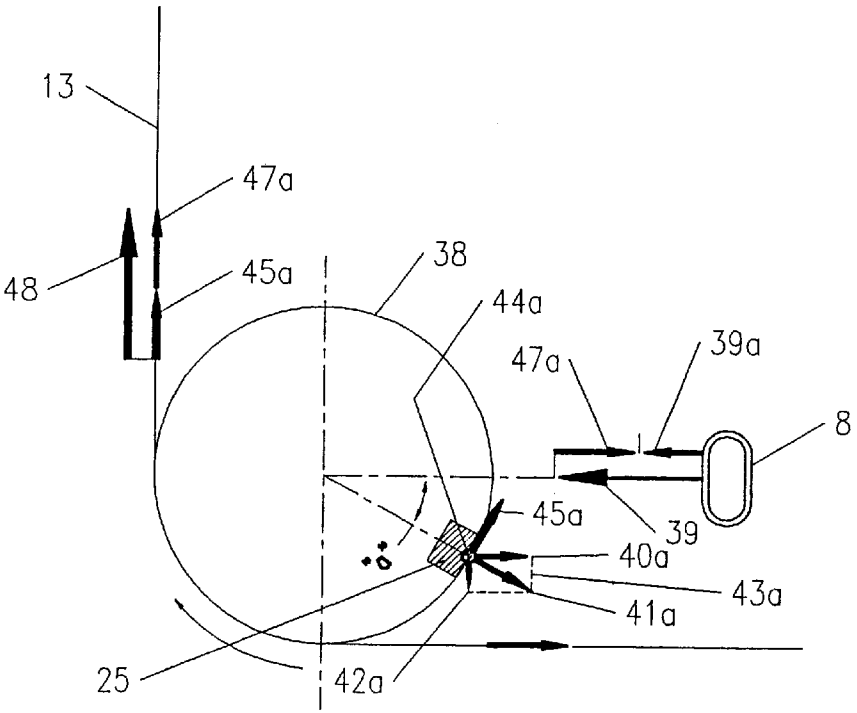
FIG. 11 is also a force diagram and shows how the upstream tension in the incoming yarn strand reduces the braking tension of the tension compensator.

FIG. 11 is also a force diagram and shows the effect of the upstream tension 47*a* of the incoming yarn strand 3. The set loading force 39 is reduced by the upstream tension 47*a* resulting in an effective loading force 39*a* which is acting on the whorl assembly 24. The generating loading force 39*a* creates at the brake shoe 25 a reaction force 40*a*. The force parallelogram 43*a* demonstrates the force multiplication in this system as follows: Since the reaction force 40*a* is not perpendicular to the brake shoe 25 at contact point 44*a* the reaction force 40*a* is broken up into a normal force 41*a* and a side thrust 42*a*. The side thrust 42*a* is counteracted in the axle 10 of the whorl assembly 24 and does not play any function in the tension generation of the tension controller "T". The product of the normal force 41 a and the friction coefficient of the brake shoe 25 and the inside surface 38 generates a drag force 45*a* which is tangential to the inside surface 38 at the contact point 44 of the brake shoe 25. The two tension components upstream tension 47*a* and drag force 45*a* result in a combined yarn tension 48 in the exiting yarn strand 13.

The tension controller "T" has a constant yarn tension 48 in the exiting yarn strand 13. The following equation establishes that the exiting yarn strand 13 is controlled in this manner:

Legend:

T1=Tension in up-stream yarn strand

T2=Set drag of the tension device

T3=Drag of the device after reduction by T1

T4 =Tension of down-stream yarn u1=Friction coefficient between brake and whorl

"a"=Offset angle of the brake shoe

Calculation for zero up-stream tension T1:

$$T4=T2$$

Calculation of added tension T3:

$$T3=T2-T1 \text{ (by definition)}$$

Calculation with up-stream tension T1:

$$T4=T1+T3=T1+(T2-T1)$$

from this follows:

$$T4=T2 \text{ (T4 not affected by T1 and constant since T2 is constant)}$$

Calculation of offset angle "a" of the brake shoe:

$$u1=\cos \text{ "}a\text{"}$$

and from this:

$$\text{"}a\text{"}=\arccos(u1)$$

Figure 12:
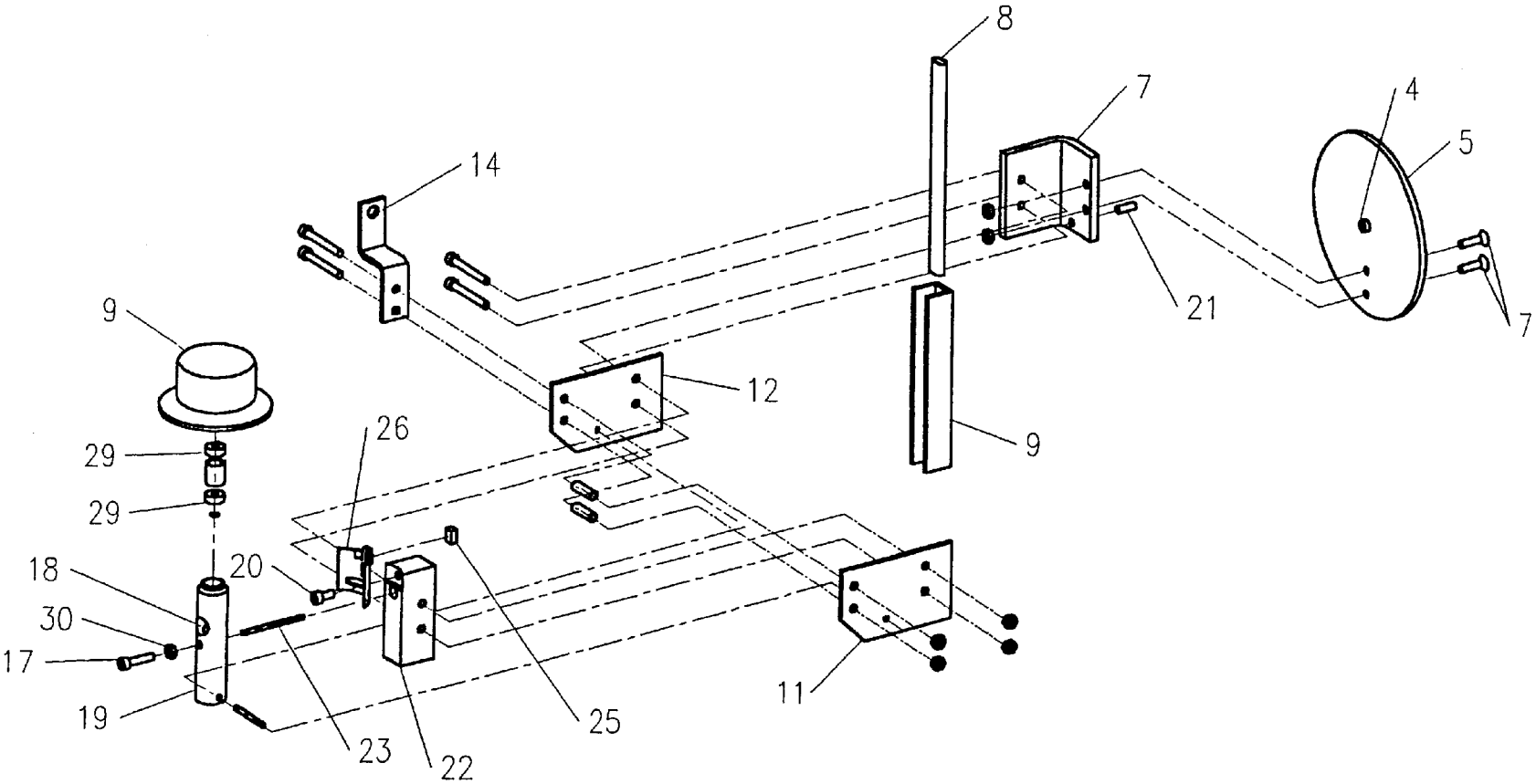
FIG. 12 is an exploded view of the tension controller with all parts shown. Center lines connect the individual parts to facilitate the understanding of how the parts fit together.

FIG. 12 is an exploded view of the tension controller "T" with all parts shown. Center lines connect the individual parts to facilitate the understanding of how the parts fit together.

Figure 13:
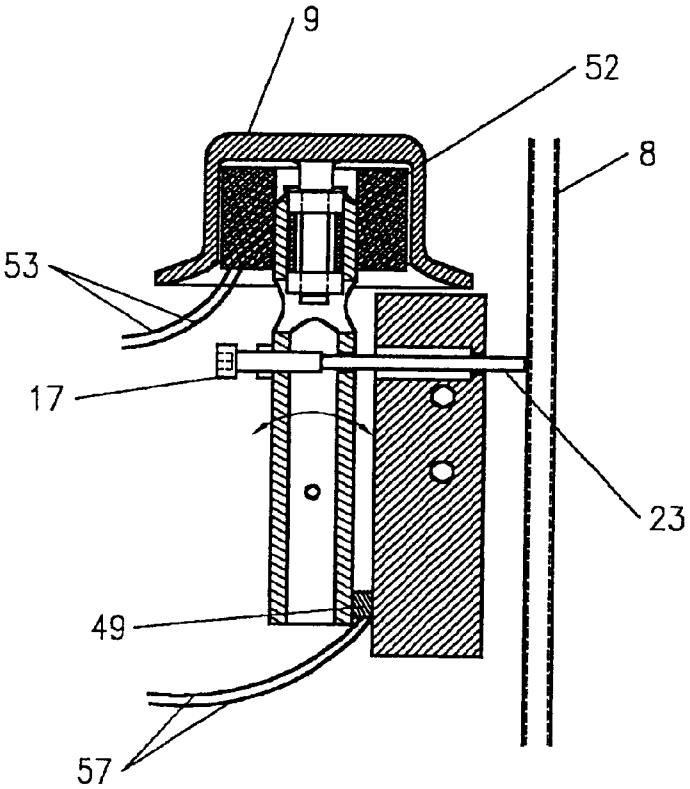
FIG. 13 is a sectioned front view of an electronic tension controller, viewing it in the direction of the exiting yarn with a pressure transducer between the pivotal whorl assembly and the body of the tension controller and an electromagnet mounted in the whorl.

In FIG. 13 a variation of the tension controller "T" is shown with the braking force to the yarn whorl 9 generated by an electromagnet 52. The braking force is achieved by applying a voltage through the electrical wires 53 to the electromagnet 52 and is generated by the effect known as "eddy-current". A pressure transducer 49 is connected by electrical wires 57 to the electromagnet 52 in series to reduce the voltage to the electrical wires 53 by which means the braking force to the yarn whorl 9 is reduced. If needed, electronic amplification (not shown) is added to the output of the pressure transducer 49 and may be properly matched through a potentiometer (not shown).

Figure 14:
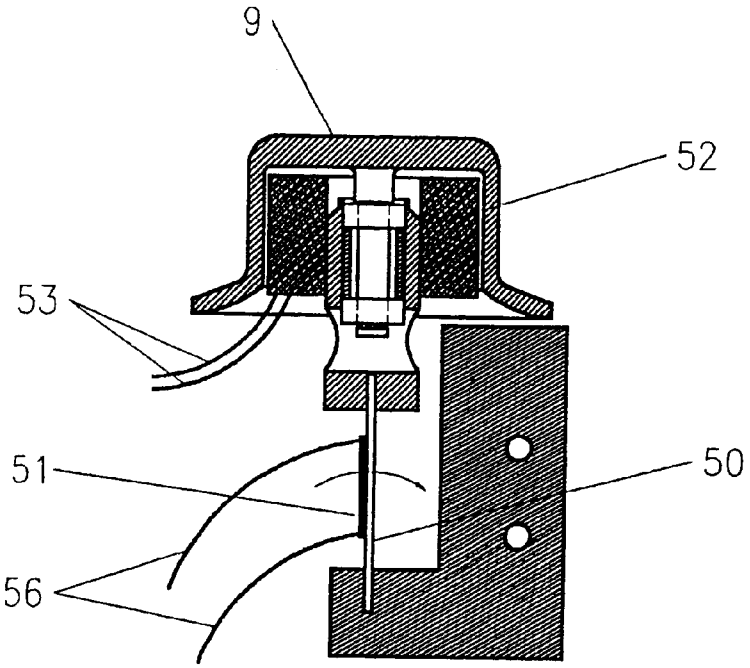
FIG. 14 is a sectioned front view of an electronic tension controller, viewing it in the direction of the exiting yarn where the whorl assembly is mounted on a spring-leaf with a strain gauge attached to it and an electromagnet mounted in the whorl.

FIG. 14 shows a variation of the method described with FIG. 13. Instead of the pre-loading of whorl assembly 24 a spring leaf 50 is employed. The tension of the incoming yarn strand 3 is deflecting the spring leaf 50 and the electrical resistance of an attached strain gauge 51 is changed. This change in resistance is amplified and reduces the voltage to the electro-magnet 52 which in turn reduces the braking force to the yarn whorl 9. The strain gauge 51 is attached to an amplifier (not shown) by the electrical wires 56.

Figure 15:
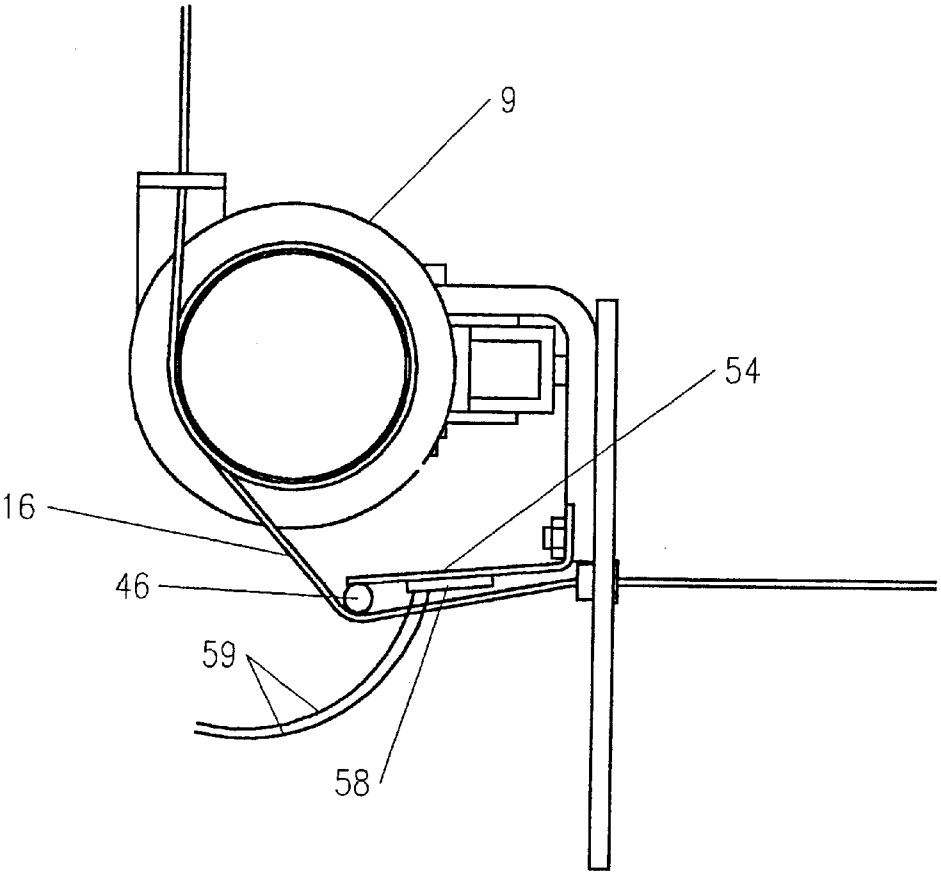
FIG. 15 is a top view of an electronic tension controller yarn with a solidly mounted whorl and a spring-leaf arm with a strain gauge attached to it to measure the tension in the incoming yarn strand.

In FIG. 15 the yarn whorl 9 is solidly mounted to the body of the tension controller "T". A spring-leaf arm 54 is deflected by the tension in the yarn strand 16 which is guided around guide 46. This deflection is also straining the strain gauge 58 and the change in resistance is amplified and reduces the voltage to the electromagnet 52 inside the yarn whorl 9, which in turn reduces the braking force to the yarn whorl 9. The strain gauge 58 is attached to an amplifier (not shown) by electrical wires 59.

Figure 16:
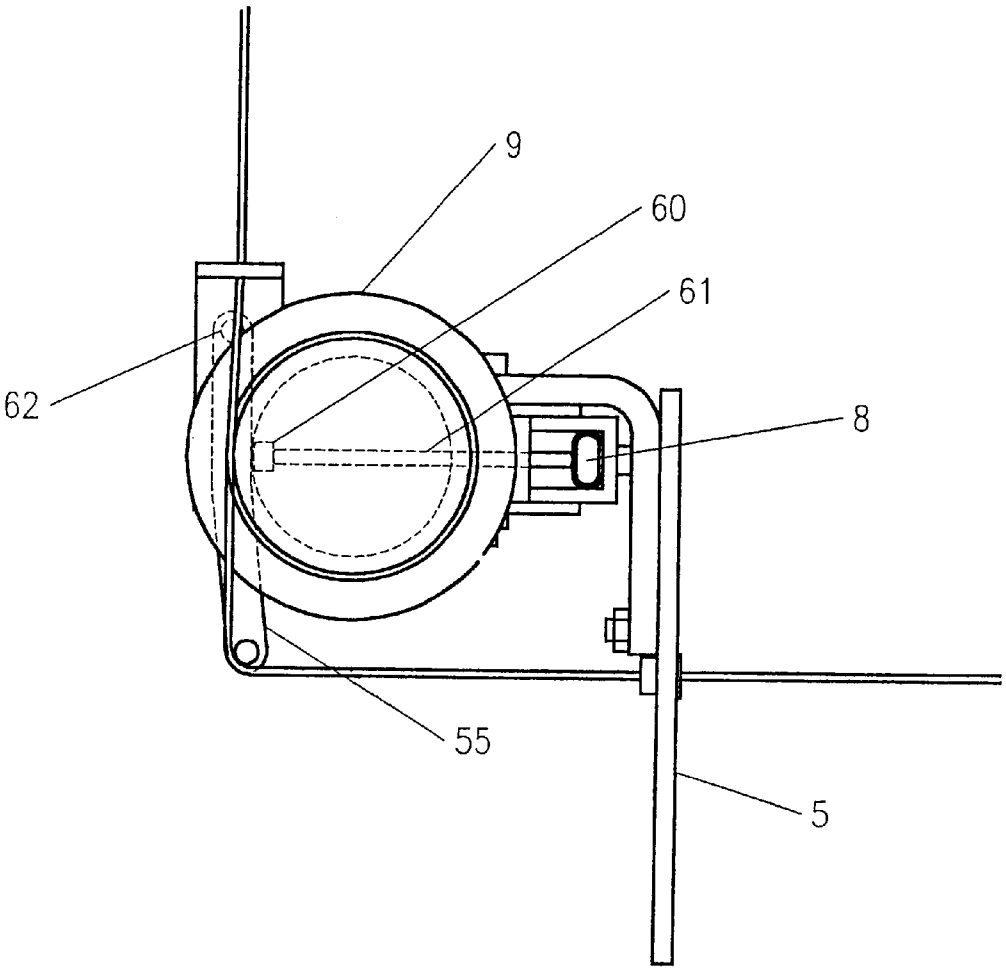
FIG. 16 is a top view of an electronic tension controller yarn with a solidly mounted whorl and a pivotal yarn arm which relieves the brake pressure partially.
Figure 17:
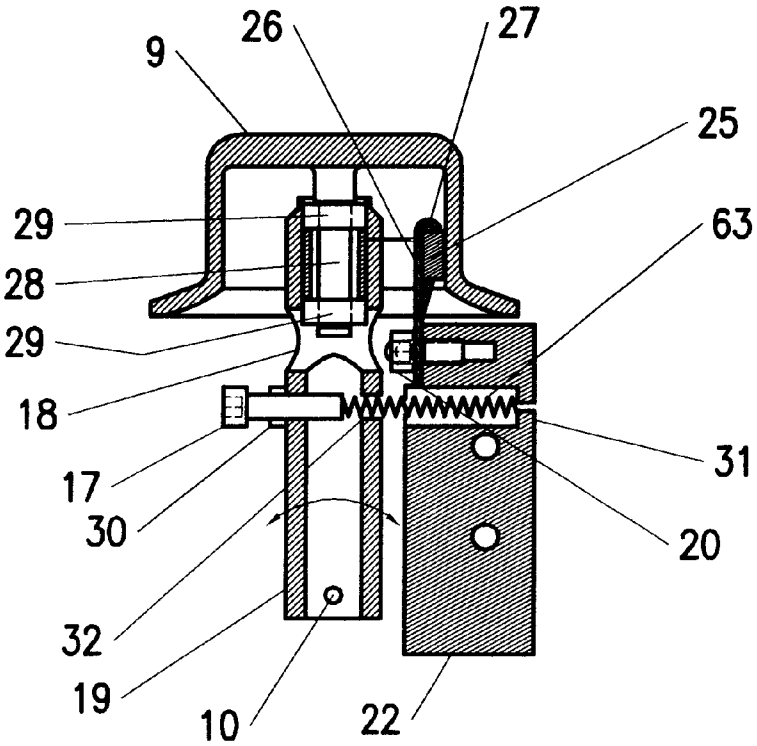
FIG. 17 is a vertical cross-section view of a tension controller showing a spring used as a forced applying means.
Figure 18:
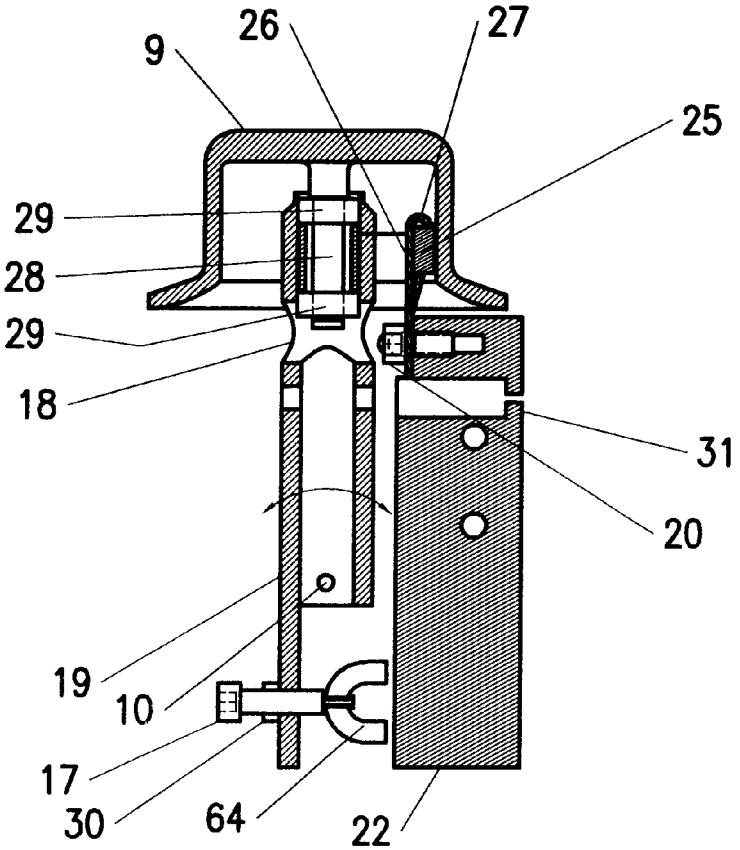
FIG. 18 is a vertical cross-section view of a tension controller showing a magnet used as a forced applying means.
Figure 19:
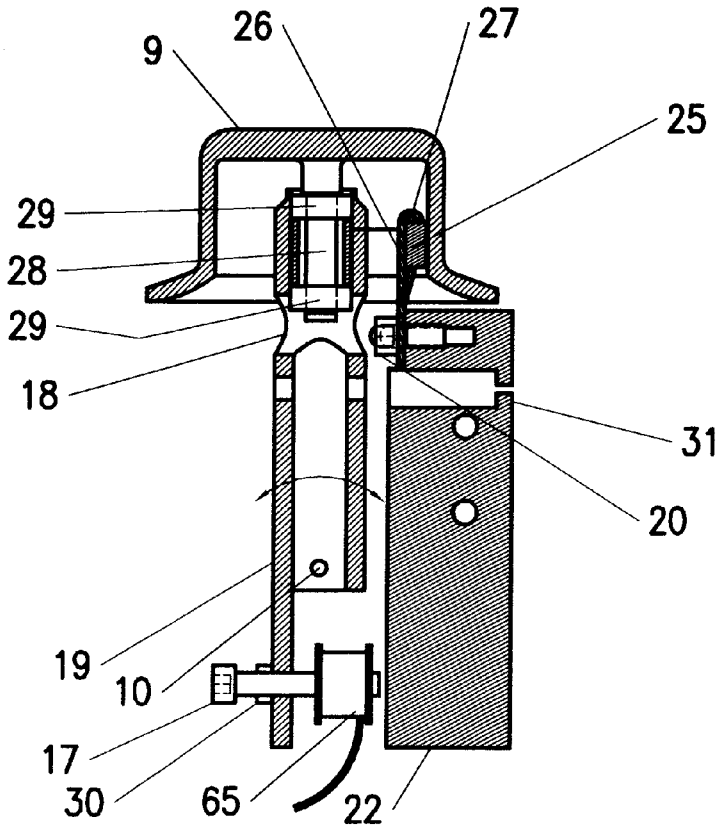
FIG. 19 is a vertical cross-section view of a tension controller showing an electro magnet used as a forced applying means.
Figure 20:
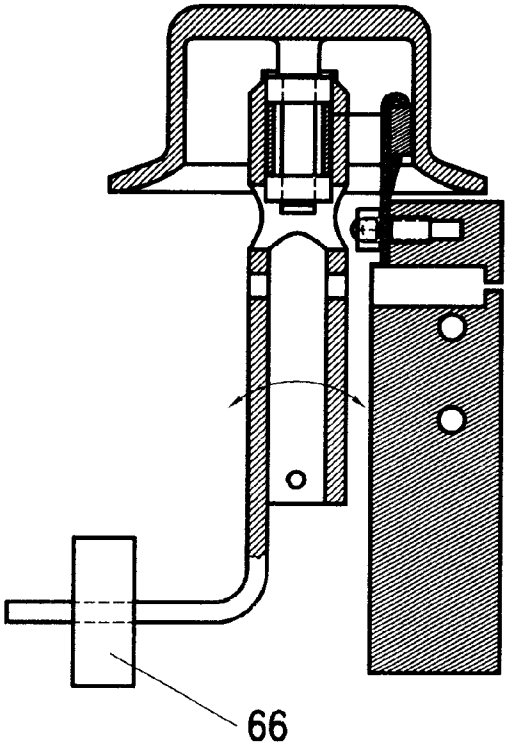
FIG. 20 is a vertical cross-section view of a tension controller showing a weight used as a forced applying means.

FIG. 16 is a mechanical tension controller "T" with a brake shoe 60 pushing against the inside of a yarn whorl 9 which is solidly mounted to the body of the tension controller "T". The pushing force is determined by the fluid pressure in the air tube 8 and is transmitted to the brake shoe 60 through the connector pin 61. The yarn arm 55 is pivotal mounted in the body of the tension controller "T" at pivot pin 62 and contacts the brake shoe 60 below the yarn whorl 9. The yarn arm 55 has a counter-clockwise moment, generated by the tension in the yarn strand 16. This moment is counteracted at the brake shoe 60 where it reduces the pressure to reduce the braking force at the yarn whorl 9 and thus regulates the tension in the exiting yarn strand.

Figure 21:
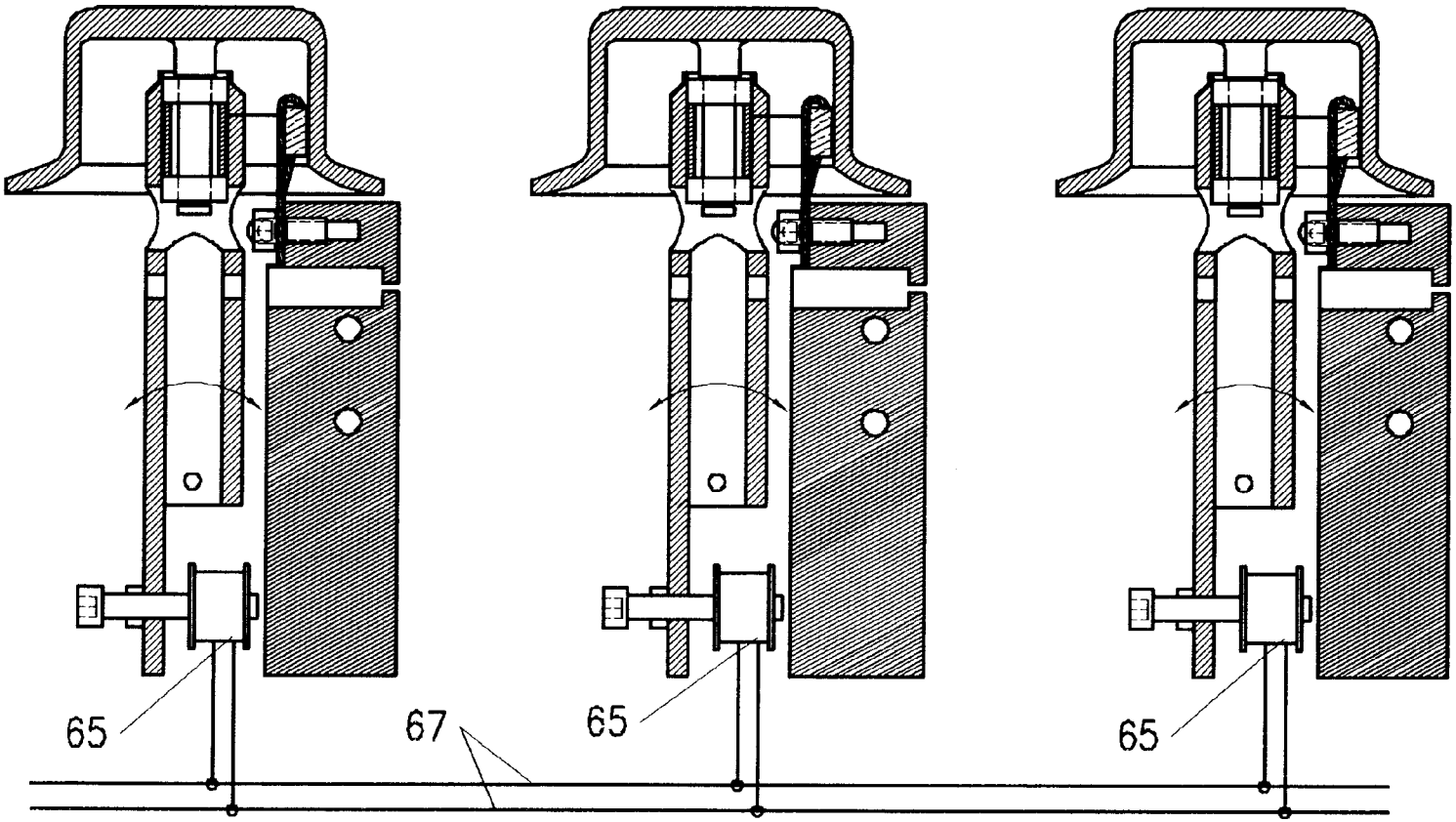
FIG. 21 is a vertical cross-section view of a plurality of tension controllers showing electric wiring of electro magnets shown in FIG. 19.

FIGS. 17–20 illustrate a tension controller showing a spring, magnet, electro magnet, or weight used as a forced applying means. FIG. 21 illustrates how the electro-magnets are connected for simultaneously changing the tension on a plurality of units.

It will be readily understood by those persons skilled in the art, that the present invention is susceptible of a broad utility and application. Many embodiments and adaptations of the present invention other than those herein described, as well as many variations, modifications, combinations and equivalent arrangements will be apparent from or reasonably suggested by the present invention and the foregoing description thereof, without departing from the substance or scope of the present invention.

What is claimed is:

1. A strand tension apparatus, comprising:

(a) a strand delivery mechanism for controllably delivering a moving strand under tension downstream from a strand supply;

(b) a strand take-up mechanism positioned downstream from the strand delivery mechanism for pulling the strand from the strand supply;

(c) a tension controller positioned between the strand delivery mechanism and the strand take-up mechanism for adding tension to the moving strand as it moves downstream from the strand delivery mechanism to the strand take-up mechanism, said tension controller including a free-wheeling, non-driven strand feeding device frictionally-engaging the strand, the tension controller also including an adjustable drag force-applying means cooperating with the rotating strand feeding device for adding a predetermined tension within a range of adjustment to the strand as the strand is delivered downstream from the strand delivery mechanism; and (d) tension responsive drag-force varying means cooperating with the adjustable drag-force applying means and responsive to the tension on the strand being delivered from the strand delivery mechanism for reducing the amount of drag added to the strand by an amount equal to the tension of the strand being delivered to the tension controller, thereby resulting in delivery of a strand under uniform tension downstream from the tension controller to the take-up mechanism.

2. A strand tension apparatus according to claim 1, wherein the rotating strand feeding device comprises a whorl around which the strand is wrapped.

3. A strand tension apparatus according to claim 2, wherein the free-wheeling, non-driven yarn feeding device is flexibly mounted and includes a brake for pushing the rotating yarn feeding device against a brake shoe to apply a drag force to the whorl for adding tension to said strand.

4. A strand tension apparatus according to claim 3, and including brake shoe adjustment means for adjusting the position of said brake shoe adjust the drag force for the specific coefficient of friction between the brake shoe and the rotating strand feeding device.

5. A strand tension apparatus according to claim 3, and including a spring for applying a braking force to the brake.

6. A strand tension apparatus according to claim 3, and including a magnet for applying a braking force to the brake.

7. A strand tension apparatus according to claim 3, and including an electromagnet for applying a braking force to the brake.

8. A strand tension apparatus according to claim 7, and including pressure means for applying a like electromagnetic force simultaneously to a plurality of tension controllers.

9. A strand tension apparatus according to claim 3, and including a fluid pressure apparatus for applying a fluid pressure braking force to the brake.

10. A strand tension apparatus according to claim 9, and including a fluid pressure adjusting apparatus for varying the fluid pressure applied to the brake.

11. A strand tension apparatus according to claim 9, and including pressure means for applying a like fluid pressure simultaneously to a plurality of tension controllers.

12. A strand tension apparatus according to claim 8 or 11, and including a fine-scale force-adjusting device on each one of the plurality of tension controllers for adjusting the braking force independent of each of the other plurality of tension controllers.

13. A strand tension apparatus according to claim 8 or 11, wherein the pressure means is adjustable during operation of the tension controller.

14. A strand tension apparatus according to claim 3, and including a weight for applying a braking force to the brake.

15. A strand tension apparatus according to claim 1, and including:

(a) a brake shoe flexibly mounted relative to said whorl for applying a braking force against the rotating yarn feeding device to apply a drag force to said whorl in order to add tension to said strand; and a yarn lever around which the incoming yarn strand is partially deflected for pulling the brake shoe with said yarn lever in an opposite direction as the brake applying force to reduce the applied tension to the yarn strand.

16. A strand tension apparatus according to claim 1, wherein:

(a) the free-wheeling, non-driven yarn feeding device is flexibly mounted, and includes an electric brake for applying a braking force to said rotating yarn feeding device in order to add tension to said strand;

(b) a pressure transducer is provided against which the strand is pulled in order to create a resistance proportional to a change in tension in the strand upstream of the strand tension controller; and (c) an electronic amplifier is operatively associated with the transducer for converting the change in resistance in the transducer into a reduction of said holdback force of the rotating yarn feeding device.

17. A strand tension apparatus according to claim 1, and further comprising:

(a) a flexibly-mounted yarn lever;

(b) an electric brake for applying a braking force to said yarn feeding device in order to add tension to said strand;

(c) a yarn guide on said yarn lever around which the yarn strand is partially deflected;

(d) a transducer for measuring the deflection force of the yarn strand at the yarn guide; and (e) an electronic amplifier for converting the change in resistance of the transducer caused by the change in pressure into a reduction of said holdback force of the rotating yarn feeding device.

18. A strand tension apparatus according to claim 1, wherein the yarn strand downstream of the tension controller is pulled from the yarn feeding device in a direction in which the strand tension does not affect the tension on the strand upstream of the tension controller.

19. A strand tension apparatus according to claim 1, wherein the tension responsive drag-force adjusting means cooperate with the drag-force applying means responsive to the tension on the strand being delivered from the strand delivery mechanism for reducing the amount of drag added to the strand by the drag-force applying means by a value equal to the tension of the strand upstream from the tension controller to deliver a strand under uniform tension downstream from the tension controller to the take-up mechanism.

20. A method of controlling strand tension in a moving strand, comprising the steps of:

(a) feeding the strand downstream with a free wheeling, nondriven rotating member of a tension controller.

(b) adding a desired drag force to the rotating member of the tension controller to add tension to the strand;

(c) detecting the tension in the strand moving downstream to the tension controller; and (d) reducing the drag force on the rotating member in response to the tension detected in the strand moving downstream to the tension controller by a value sufficient to deliver the strand under uniform tension downstream from the tension controller to a downstream take-up mechanism.

21. A method of controlling strand tension according to claim 20, where the reduction of said drag force results in a reduction of said added tension equal to the tension of the incoming strand.

22. A method of controlling strand tension according to claim 20 or 21 wherein the tension is applied by applying a drag force the rotating member and by transferring the drag force of the rotating member into tension in the strand which is wrapped with sufficient wrapping around the rotating member to prevent slippage.

23. A strand tension apparatus, comprising:

(a) a strand delivery mechanism for controllably delivering a moving strand under tension downstream from a strand supply;

(b) a strand take-up mechanism positioned downstream from the strand delivery mechanism for pulling the strand from the strand supply;

(c) a tension controller positioned between the strand delivery mechanism and the strand take-up mechanism for adding tension to the moving strand as it moves downstream from the strand delivery mechanism to the strand take-up mechanism, said tension controller including a flexibly-mounted rotating whorl around which the strand is wrapped, the tension controller also including a brake for pushing the rotating whorl against a brake shoe for adding a predetermined drag within a range of adjustment to the strand as the strand is delivered downstream from the strand delivery mechanism; and (d) tension responsive drag-force varying means cooperating with the adjustable drag-force applying means and responsive to the tension on the strand being delivered from the strand delivery mechanism for reducing the amount of drag added to the strand by an amount equal to the tension of the strand being delivered to the tension controller, thereby resulting in delivery of a strand under uniform tension downstream from the tension controller to the take-up mechanism.

* * * * *

UNITED STATES PATENT AND TRADEMARK OFFICE

CERTIFICATE OF CORRECTION

PATENT NO. : 6,457,666 B1
APPLICATION NO. : 09/673682
DATED : October 1, 2002
INVENTOR(S) : Kurt W. Niederer It is certified that error appears in the above-identified patent and that said Letters Patent is hereby corrected as shown below:

In column 9, line 57, insert -- (b) -- before "a yarn lever".

Signed and Sealed this

Fifteenth Day of July, 2008

JON W. DUDAS
*Director of the United States Patent and Trademark Office*